US011692672B2

(12) United States Patent
Moore, III et al.

(10) Patent No.: US 11,692,672 B2
(45) Date of Patent: Jul. 4, 2023

(54) PRESSURE RELIEF SHIPPING ADAPTER FOR A BOTTLE HEAD ASSEMBLY

(71) Applicant: Lockheed Martin Corporation, Bethesda, MD (US)

(72) Inventors: James Robert Moore, III, Fort Worth, TX (US); Mark S. Osborne, Fort Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 127 days.

(21) Appl. No.: 17/125,330

(22) Filed: Dec. 17, 2020

(65) Prior Publication Data

US 2022/0196212 A1 Jun. 23, 2022

(51) Int. Cl.

| | |
|---|---|
| ***F17C 13/04*** | (2006.01) |
| ***F15B 5/00*** | (2006.01) |
| ***B67D 7/36*** | (2010.01) |
| ***B67D 7/78*** | (2010.01) |

(52) U.S. Cl.

CPC ..... *F17C 13/04* (2013.01); *B67D 7/36* (2013.01); *B67D 7/362* (2013.01); *B67D 7/78* (2013.01); *F15B 5/00* (2013.01); *F17C 2205/037* (2013.01); *F17C 2205/0332* (2013.01); *F17C 2205/0382* (2013.01)

(58) Field of Classification Search

CPC ..... F17C 2270/0189; F17C 2270/001; F17C 2205/0382; F17C 2205/037; F17C 2205/0332; F17C 13/04; F15B 5/00; B67D 7/78; B67D 7/362; B67D 7/36

See application file for complete search history.

(56) References Cited

U.S. PATENT DOCUMENTS

| | | | | |
|---|---|---|---|---|
| 4,420,013 | A * | 12/1983 | DiBlasio | F17C 13/002 137/382 |
| 4,441,357 | A | 4/1984 | Kahn et al. | |
| 4,499,914 | A | 2/1985 | Bernard et al. | |
| 4,651,728 | A | 3/1987 | Gupta et al. | |
| 4,766,763 | A | 8/1988 | Kurtz | |
| 4,880,134 | A * | 11/1989 | Wood, Jr. | F17C 13/06 137/382 |

(Continued)

FOREIGN PATENT DOCUMENTS

| | | | |
|---|---|---|---|
| CN | 108591820 | A | 9/2018 |
| EP | 2796848 | B1 | 12/2017 |
| JP | 57008432 | A | 1/1982 |

*Primary Examiner* — Jessica Cahill

(74) *Attorney, Agent, or Firm* — Baker Botts L.L.P.

(57) ABSTRACT

In one embodiment, systems and methods include using a pressure relief shipping adapter to reduce the internal pressure of a container. A pressure relief shipping adapter comprises a body comprising a first portion and a second portion. The first portion comprises a first bore and a set of protrusions. The second portion comprises a second bore, wherein the second bore comprises a radial gap, wherein the radial gap comprises a uniform arc length along the length of the radial gap. A first end and a second end of the radial gap comprise a greater arc length than the radial gap. A pressure relief shipping adapter further comprises a pressure relief valve disposed at a first end of the first bore and an interlocking component comprising a first tab and a second tab, wherein the interlocking component is at least partially contained within the second bore.

14 Claims, 5 Drawing Sheets

(56) References Cited

U.S. PATENT DOCUMENTS

| | | | | |
|---|---|---|---|---|
| 5,282,493 | A * | 2/1994 | Schwartz | F16K 1/305 137/557 |
| 6,047,727 | A * | 4/2000 | Hatori | G05D 16/10 137/505.28 |
| 6,357,465 | B1 * | 3/2002 | Caldwell | B60T 17/04 137/71 |
| 6,439,032 | B1 | 8/2002 | Lehmann | |
| 7,818,133 | B2 | 10/2010 | Furuse | |
| 9,089,721 | B1 | 7/2015 | Horstman et al. | |
| 10,274,118 | B2 * | 4/2019 | Takezawa | F16L 29/04 |
| 10,545,067 | B2 | 1/2020 | Phaff et al. | |
| 11,519,558 | B2 * | 12/2022 | Ligonesche | F16K 35/14 |
| 2004/0221919 | A1 * | 11/2004 | MacNeal | F16L 29/02 141/384 |
| 2008/0289700 | A1 * | 11/2008 | Masingale | F16K 1/307 137/461 |
| 2013/0220447 | A1 * | 8/2013 | Zeyfang | F17C 13/04 137/382 |
| 2013/0233440 | A1 * | 9/2013 | Holder | F17C 5/06 141/69 |
| 2016/0325122 | A1 | 11/2016 | Contino et al. | |
| 2020/0240524 | A1 * | 7/2020 | Vignerol | F16K 35/14 |

* cited by examiner

PRESSURE RELIEF SHIPPING ADAPTER FOR A BOTTLE HEAD ASSEMBLY

TECHNICAL FIELD

This disclosure generally relates to pressure reduction devices, and more specifically, to a pressure relief shipping adapter for reducing an internal pressure of a container prior to transportation.

BACKGROUND

Pressurized containers of oxygen gas are supplied to aircraft to be used in urgent situations. There is currently no tool, system, or method capable of verifying a safe condition of contents of these containers by reducing the internal pressure to a predetermined threshold value prior to transportation to the aircraft.

SUMMARY

According to an embodiment, a pressure relief shipping adapter comprises a body comprising a first portion and a second portion. The first portion comprises a first bore and a set of protrusions, wherein a hole is disposed through the set of protrusions. The second portion comprises a second bore, wherein the second bore comprises a radial gap, wherein the radial gap comprises a uniform arc length along the length of the radial gap. A first end and a second end of the radial gap comprise a greater arc length than the radial gap. The pressure relief shipping adapter further comprises a pressure relief valve disposed at a first end of the first bore and an interlocking component comprising a first tab and a second.

According to another embodiment, a method of using a pressure relief shipping adapter that comprises coupling the pressure relief shipping adapter to a bottle head assembly, wherein the bottle head assembly is coupled to a container containing a pressurized gas. The method further comprises actuating a mechanical switch of the bottle head assembly to rotate about a set of hinges. The method further comprises reducing an internal pressure of the container by displacing a valve of the bottle head assembly into a valve depressor. The method further comprises actuating an interlocking component of the pressure relief shipping adapter from a first position to a second position, wherein the interlocking component comprises a first tab and a second tab, wherein the interlocking component is at least partially contained within a bore of the pressure relief shipping adapter that comprises a radial gap, wherein the first tab is disposed within a first end of the radial gap at the first position.

According to a further embodiment, a container pressure system comprises a bottle head assembly coupled to a container, wherein the container comprises a pressurized gas, wherein the bottle head assembly comprises a mechanical switch and a valve. The container pressure system further comprises a pressure relief shipping adapter coupled to the bottle head assembly. The pressure relief shipping adapter comprises a body comprising a first portion and a second portion. The first portion comprises a first bore and a set of protrusions, wherein a hole is disposed through the set of protrusions. The second portion comprises a second bore, wherein the second bore comprises a radial gap, wherein the radial gap comprises a uniform arc length along the length of the radial gap, wherein a first end and a second end of the radial gap comprise a greater arc length than the radial gap. The pressure relief shipping adapter further comprises a pressure relief valve disposed at a first end of the first bore and an interlocking component comprising a first tab and a second tab, wherein the interlocking component is at least partially contained within the second bore.

In the disclosed embodiments, a pressure relief shipping adapter couples to a bottle head assembly that is attached to a pressurized container. The pressure relief shipping adapter is configured to reduce an internal pressure of the container to a predetermined threshold value. A switch on the bottle head assembly may be operable to force a valve into a valve depressor to vent any pressurized contents from the container. The vented contents may be sealed within the pressure relief shipping adapter and may be released through a pressure relief valve. These embodiments may provide for an operator to verify a safe condition of contents of these containers by reducing the internal pressure to the predetermined threshold value prior to transportation.

Certain embodiments may include none, some, or all of the technical advantages discussed above. One or more other technical advantages may be readily apparent to one skilled in the art from the figures, descriptions, and claims included herein.

BRIEF DESCRIPTION OF THE DRAWINGS

To assist in understanding the present disclosure, reference is now made to the following description taken in conjunction with the accompanying drawings, in which.

DETAILED DESCRIPTION

To facilitate a better understanding of the present disclosure, the following examples of certain embodiments are given. The following examples are not to be read to limit or define the scope of the disclosure. Embodiments of the present disclosure and its advantages are best understood by referring to FIGS. 1 through 5, where like numbers are used to indicate like and corresponding parts.

Figure 1:
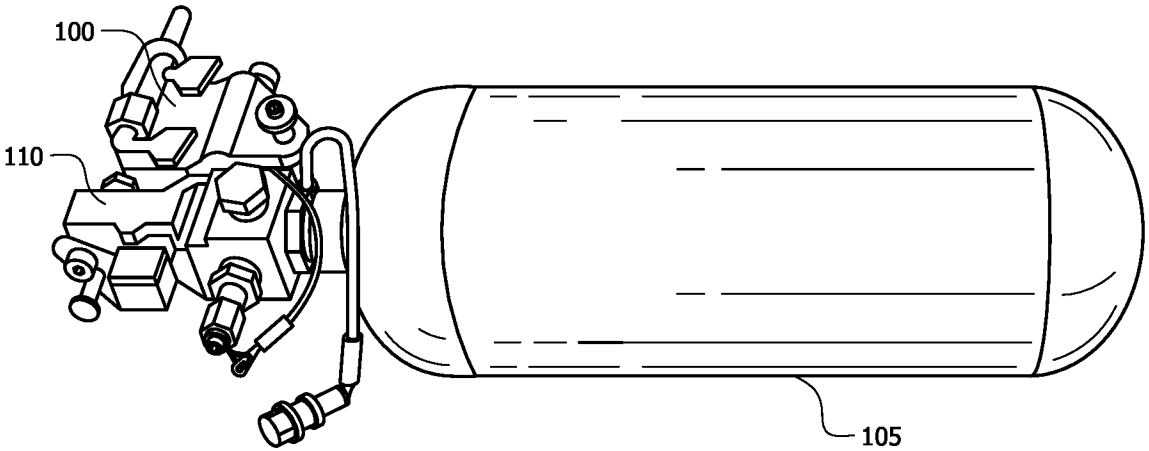
FIG. 1 illustrates an example pressure relief shipping adapter and an example container, according to certain embodiments.

Described herein are various systems, tools, and methods that provide for a structure to reduce the pressure within a pressurized container of oxygen gas prior to shipping and/or transportation. FIG. 1 illustrates a perspective view of a pressure relief shipping adapter 100 coupled to a container 105. The pressure relief shipping adapter 100 may be configured to reduce the internal pressure of the container 105 to a predetermined value. In one or more embodiments, the container 105 may be a pressure vessel configured to store a gas at a predetermined pressure. Without limitations, the container 105 may contain a volume of oxygen gas. In embodiments, the container 105 may be any suitable size, height, shape, and combinations thereof. Without limitations, the container 105 may generally be a cylindrical tank. The container 105 may comprise any suitable materials configured to withstand a predetermined internal pressure. Without limitations, the suitable materials may be metals, nonmetals, composites, and any combinations thereof.

As illustrated, a bottle head assembly 110 may be disposed on top of and coupled to the container 105. In embodiments, there may be an opening through the top of the container 105 to allow for fluid communication between an interior and an exterior of the container 105 of a given gas. As the bottle head assembly 110 is coupled to the top of the container 105, the interior of the container 105 may effectively be sealed. In embodiments, the bottle head assembly 110 may be any suitable size, height, shape, and combinations thereof, and the bottle head assembly 110 may comprise any suitable materials. Without limitations, the suitable materials may be metals, nonmetals, composites, polymers, and any combinations thereof. In one or more embodiments, the pressure relief shipping adapter 100 may be coupled to the container 105 through the bottle head assembly 110.

Figure 2:
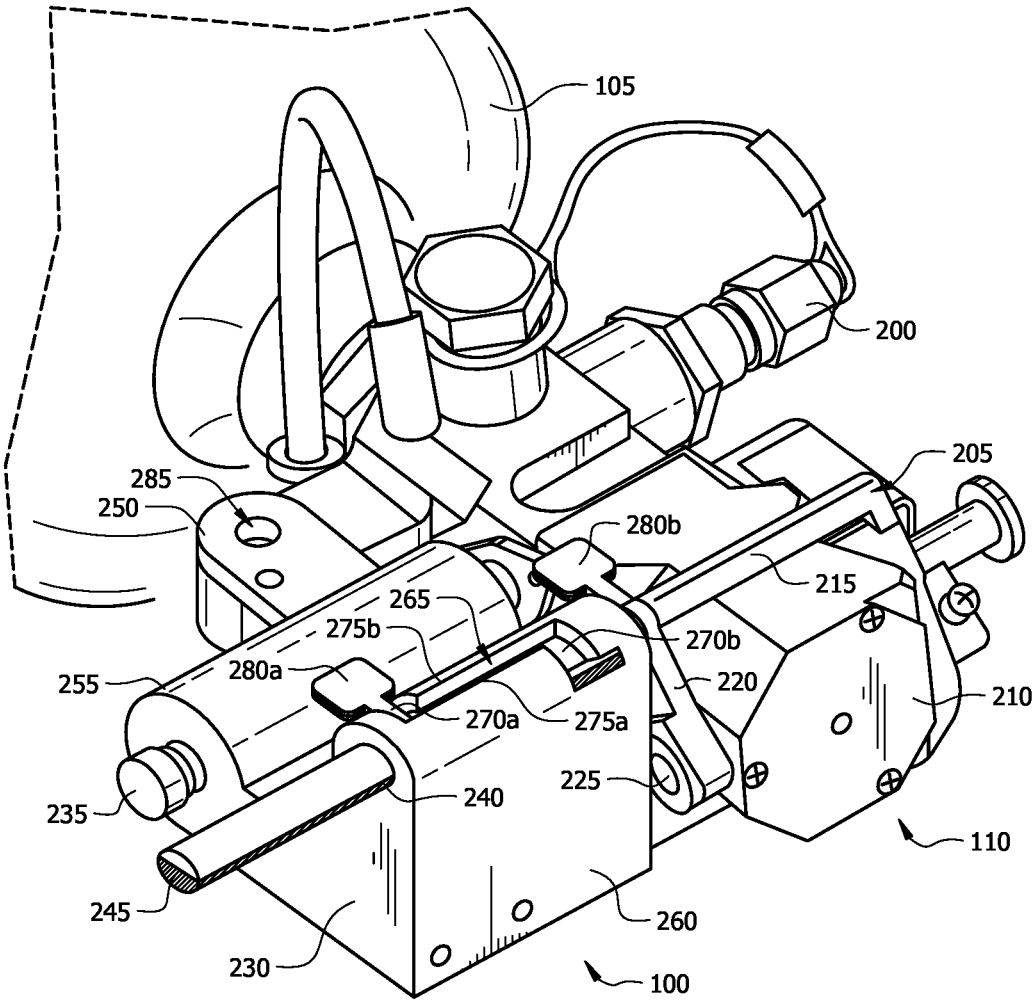
FIG. 2 illustrates an example perspective view of the pressure relief shipping adapter in FIG. 1 coupled to an example bottle head assembly, according to certain embodiments.

FIG. 2 illustrates a perspective view of the pressure relief shipping adapter 100 coupled to the bottle head assembly 110. The bottle head assembly 110 may be configured to seal the container 105, to pressurize the container 105, to depressurize the container 105, and any combinations thereof. In embodiments, the bottle head assembly 110 may comprise a servicing port 200 and a mechanical switch 205. The servicing port 200 may be disposed about any suitable location on the bottle head assembly 110. The servicing port 200 may be configured to couple to an external source and allow the flow of a gas (for example, oxygen), into the interior of the container 105. The servicing port 200 may be configured to only allow the flow of the gas one way, such as into the container 105. There may be other suitable components, such as valves, used within the bottle head assembly 110 to preserve the gas within the container 105. As the volume of gas flowing into the container 105 increases, the pressure within the container 105 may increase accordingly.

As illustrated, the mechanical switch 205 may be disposed near a top end 210 of the bottle head assembly 110. As shown, the mechanical switch 205 may be coupled to opposing sides of the bottle head assembly 110 near the top end 210 so as to be at least partially disposed around the bottle head assembly 110. In other embodiments, the mechanical switch 205 may be disposed about any suitable location on the bottle head assembly 110. The mechanical switch 205 may be configured to actuate between a first position and a second position, wherein switching between the first position and the second position may subsequently affect other components of the bottle head assembly 110. In embodiments, the mechanical switch 205 may be any suitable size, height, shape, and combinations thereof. The mechanical switch 205 may comprise any suitable materials such as metals, nonmetals, composites, and any combinations thereof.

The mechanical switch 205 may comprise a lateral bar 215, a set of coupling bars 220, and a set of hinges 225. The set of coupling bars 220 may be disposed at opposite sides of the lateral bar 215. In embodiments the set of coupling bars 220 may be perpendicular to the lateral bar 215. Each of the hinges 225 may be disposed at distal ends of each of the coupling bars 220 opposite from where the coupling bars 220 are connected to the lateral bar 215. The set of hinges 225 may couple the distal ends of the set of coupling bars 220 to the top end 210 of the bottle head assembly 110 and may provide a means of rotation for the mechanical switch 205, wherein the mechanical switch 205 may rotate about the set of hinges 225. Without limitations, the mechanical switch 205 may rotate any suitable degree range from the first position to the second position. In embodiments, the mechanical switch 205 may rotate within a degree range from about 0° to about 270°.

Figure 3:
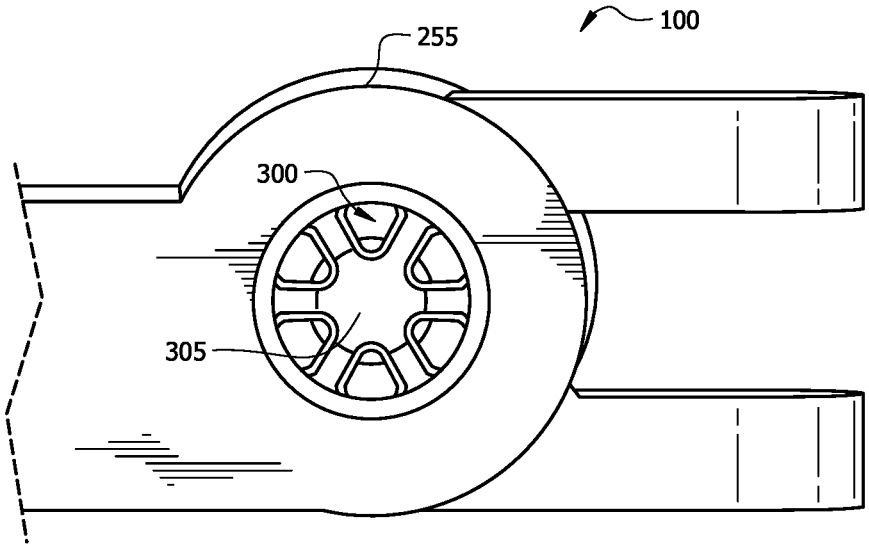
FIG. 3 illustrates an example side view of the pressure relief shipping adapter in FIG. 1, according to certain embodiments.

The pressure relief shipping adapter 100 may be coupled to the bottle head assembly 110 and may interact with components of the bottle head assembly 110. As previously described, the pressure relief shipping adapter 100 may be configured to reduce the internal pressure of the container 105 to a predetermined value. The pressure relief shipping adapter 100 may comprise a body 230, a pressure relief valve 235, a first bore 240, an interlocking component 245, and a set of protrusions 250. In embodiments, the body 230 may be any suitable size, height, shape, and combinations thereof. The body 230 may comprise any suitable materials such as metals, nonmetals, composites, and any combinations thereof. The body 230 may be configured to house, contain, accommodate, and any combinations thereof any of the other components of the pressure relief shipping adapter 100 and/or of the bottle head assembly 110. The body 230 may comprise a first portion 255 and a second portion 260. The first portion 255 of the body 230 may generally be cylindrical in shape and may comprise a through-bore (as seen in FIG. 3). The second portion 260 of the body 255 may be disposed adjacent to the first portion 255 and may generally have a rectangular shape.

The pressure relief valve 235 may be disposed about the first portion 255 of the body 230. As disclosed, the pressure relief valve 235 may be disposed about one end of the through-bore of the first portion 255, wherein the bottle head assembly 110 may be coupled to the opposing end of the through-bore. Without limitations, any suitable pressure relief valve may be used as the disclosed pressure relief valve 235. In embodiments, the pressure relief valve 235 may be set to a predetermined threshold value. The pressure relief valve 235 may be operable to reduce an internal pressure of the container 105 to the predetermined value of the pressure relief valve 235, based, at least in part, on the operation of the mechanical switch 205.

The first bore 240 may be disposed about the second portion 260 of the body 230, wherein the direction of the first bore 240 may be perpendicular to a central axis of the bottle head assembly 110. The first bore 240 may fully extend through the second portion 260. In embodiments, the first bore 240 may not be fully enclosed but may be partially open. As illustrated, there may be a radial gap 265 disposed through a portion of the second portion 260 of the body 230 that exposes the first bore 240 to an external environment. The radial gap 265 may have a uniform arc length along the length of the radial gap 265, wherein the arc length is the distance between two opposing points along a section of a curve (for example, the portion of the second portion 260 designated as the radial gap 265). At each of a first end 270*a* and a second end 270*b* (collectively referred to herein as the "ends 270") of the radial gap 265, the arc length may be greater than the arc length along the length of the radial gap 265. For example, the central angle used to calculate the arc length at the ends 270 may be greater than the central angle used to calculate the arc length along the length of the radial gap 265. In embodiments, the arc length at both of the ends 270 may be equivalent. While the arc length at the ends 270 may be greater than that along the length of the radial gap 265, each of the first end 270*a* and the second end 270*b* may share a common point used in determining the arc length with the section along the length of the radial gap 265. For example, the arc length along the length of the radial gap 265 may be determined from a first point 275*a* and a second point 275*b* of a portion of the circumference of the first portion. The arc length of the first end 270*a* may be determined, at least in part, on the first point 275*a*, and the arc length of the second end 270*b* may be determined, at least in part, on the second point 275*b*. As such, the arc lengths of the first end 270*a* and the second end 270*b* may be disposed in opposing tangential directions from each other.

As illustrated, the first bore 240 may be configured to receive and at least partially contain the interlocking component 245. In embodiments, the interlocking component 245 may be any suitable size, height, shape, and combinations thereof. The interlocking component 245 may generally be in the shape of a rod or an elongated cylinder. The interlocking component 245 may comprise any suitable materials such as metals, nonmetals, composites, and any combinations thereof. The interlocking component 245 may be configured to interact with the mechanical switch 205 of the bottle head assembly 110. The interlocking component 245 may comprise a first tab 280*a* and a second tab 280*b* (collectively referred to herein as the "tabs 280"). Both the first tab 280*a* and the second tab 280*b* may be structures disposed along the length of the interlocking component 245 and extend outwards from the interlocking component 245. In embodiments, both tabs 280 may comprise the same size, height, shape, and combinations thereof. Both tabs 280 further may be disposed in the same direction parallel to each other. During operations, the interlocking component 245 may be configured to translate at least partially along the first bore 240, wherein the first tab 280*a* may be confined by the radial gap 265.

To couple the pressure relief shipping adapter 100 to the bottle head assembly 110, the set of protrusions 250 may be utilized. The set of protrusions 250 may be disposed about the first portion 255 of the body 230 opposite to the second portion 260. The set of protrusions 250 may comprise a hole 285 configured to receive a pin (not shown) to fix the pressure relief shipping adapter 100 to the bottle head assembly 110. The hole 285 may be located at the same position on each of the protrusions 250 to where there is a single, concentric hole as hole 285. In embodiments, a portion of the bottle head assembly 110 may be disposed between the set of protrusions 250, wherein that portion may also have a hole. The hole of the portion of the bottle head assembly 110 may be aligned with the hole 285, wherein the pin (not shown) may be disposed through the hole 285 and the hole in the portion of the bottle head assembly 110. In one or more embodiments, any suitable fasteners may be used with or in replacement of the pin to secure the set of protrusions 250 to the portion of the bottle head assembly 110, thereby coupling the pressure relief shipping adapter 100 to the bottle head assembly 110.

FIG. 3 illustrates a side view of the pressure relief shipping adapter 100. As illustrated, a second bore 300 may be defined as the through-bore of the first portion 255 of the body 230 (referring to FIG. 2). As previously disclosed, the pressure relief valve 235 (referring to FIG. 2) may be disposed at one end of the second bore 300 and the bottle head assembly 110 (referring to FIG. 1) may be coupled to the opposite end of the second bore 300. There may be a valve depressor 305 disposed within the second bore 300 configured to actuate a valve (shown on FIG. 5) on the bottle head assembly 110. In embodiments, the valve depressor 305 may be disposed at any suitable position along the length of the second bore 300. The valve depressor 305 may be disposed about the middle of the second bore 300, near one end of the second bore 300, or near the opposing end of the second bore 300. In embodiments, the valve depressor 305 may be any suitable size, height, shape, and combinations thereof. The valve depressor 305 may generally comprise a circular shape with one or more extensions extending outwards towards a wall defining the second bore 300. The valve depressor 305 may further comprise any suitable materials such as metals, nonmetals, composites, and any combinations thereof. During operations, a force may be applied to push the valve of the bottle head assembly 110 into the valve depressor 305 to open a channel providing communication from within the container 105 (referring to FIG. 1) to outside the container 105, wherein this communication may provide gas to flow out of the container 105.

Figure 4A:
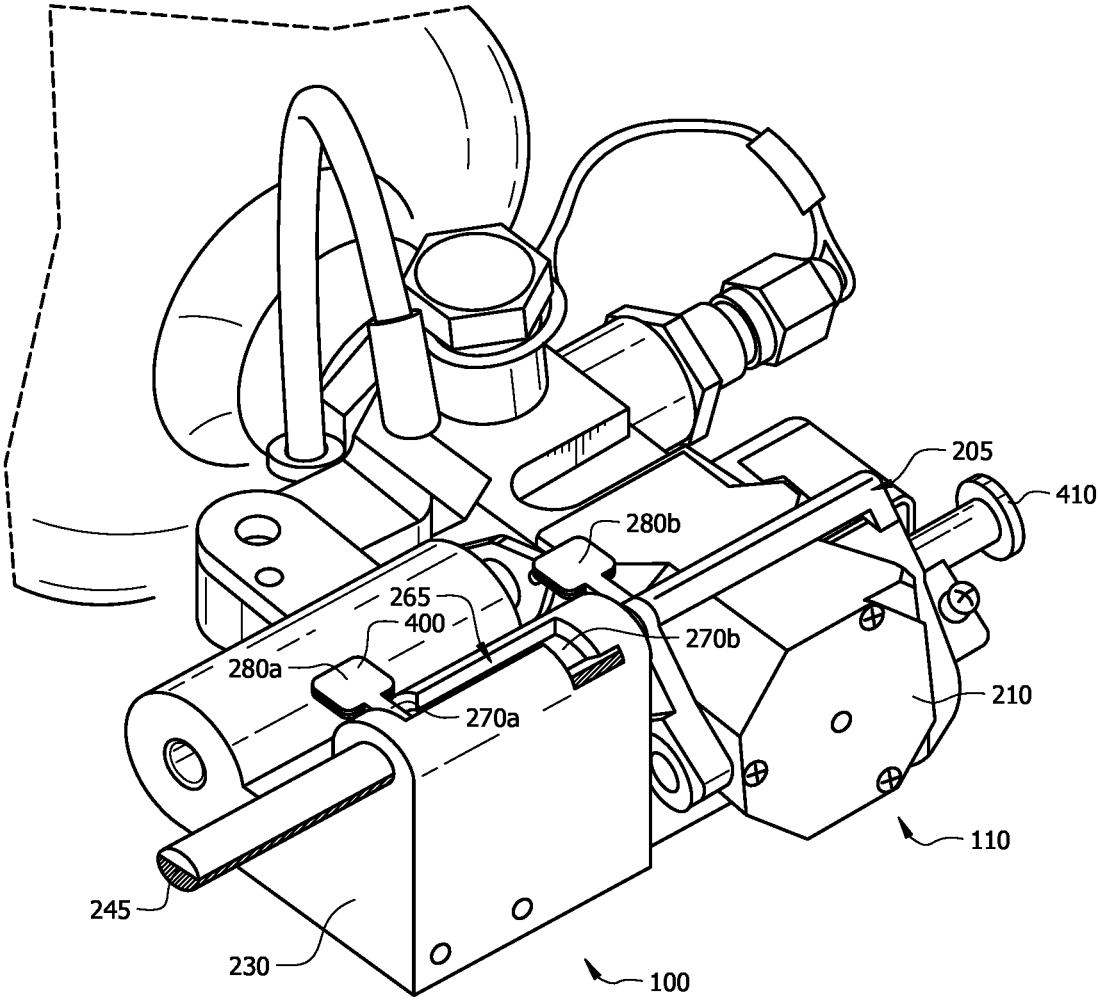
FIG. 4A illustrates an example perspective view of the pressure relief shipping adapter in FIG. 1 in a first position, according to certain embodiments.
Figure 4B:
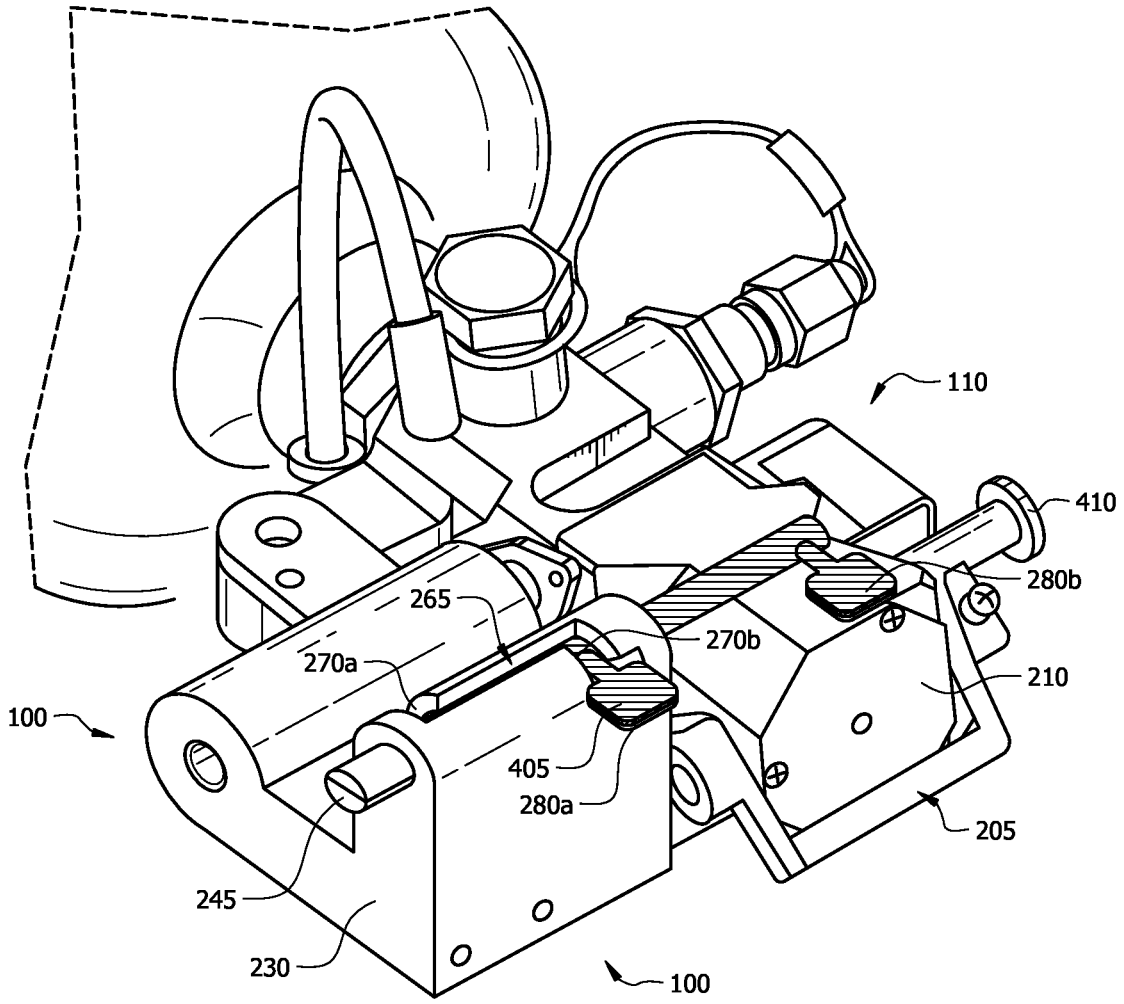
FIG. 4B illustrates an example perspective view of the pressure relief shipping adapter in FIG. 1 in a second position, according to certain embodiments.

FIGS. 4A-4B illustrate perspective views of the pressure relief shipping adapter 100 coupled to the bottle head assembly 110 in different positions. FIG. 4A illustrates the pressure relief shipping adapter 100 in a first position, and FIG. 4B illustrates the pressure relief shipping adapter 100 in a second position. As illustrated, the pressure relief shipping adapter 100 may be coupled to the bottle head assembly 110 while in the first position, wherein the first tab 280*a* of the interlocking component 245 may be disposed in the first end 270*a* of the radial gap 265. The second tab 280*b* may be disposed adjacent to the body 230 between the pressure relief shipping adapter 100 and the bottle head assembly 110. At this stage, the pressure relief shipping adapter 100 may be at the first position, and the mechanical switch 205 may be at the first position. The first position of the mechanical switch 205 may be where the mechanical switch 205 is disposed against a surface of the bottle head assembly 100 perpendicular to the top end 210. During operations, the mechanical switch 205 may be actuated to rotate about the set of hinges 225 (referring to FIG. 2) to a second position, wherein as the mechanical switch 205 rotates, there is no physical interference from the interlocking component 245. In embodiments, before the mechanical switch 205 is rotated, a pin 410 may be actuated (for example, pushed or pulled) in order to remove any inhibiting structure of the mechanical switch 205. In embodiments, rotating the mechanical switch 205 from the first position to the second position my actuate the valve (shown on FIG. 5) of the bottle head assembly 110 to vent any contents held within the container 105 (referring to FIG. 1).

Once the mechanical switch 205 is in the second position, the pressure relief shipping adapter 100 may be operable to change to the second position, as illustrated in FIG. 4B. The first tab 280*a* may rotate about a central axis of the interlocking component 245 to align with the length of the radial gap 265. Once aligned, the first tab 280*a* may translate along the length of the radial gap 265. After translating along the length of the radial gap 265, the first tab 280*a* may be rotated along the arc length of the second end 270*b* of the radial gap 265. As the first tab 280*a* rotates and translates, the second tab 280*b* rotates and translates accordingly as they are connected through the interlocking component 245. This may be designated as the second position of the pressure shipping adapter 100. Prior to rotation, a front surface 400 of both the tabs 280 may convey information to an operator. For example, the front surface 400 may indicate to the operator that the container 105 associated with the pressure relief shipping adapter 100 is not ready for transportation or shipment between locations. The container 105 may not be ready when the internal pressure of the container 105 has not been vented or reduced to a predetermined value. Without limitations, the front surface 400 may comprise any suitable data, such as numbers and/or letters, a specific color, or combinations thereof. After rotation, a back surface 405 of both the tabs 280 may indicate to the operator that the container 105 associated with the pressure relief shipping adapter 100 is ready for transportation or shipment between locations. Similar to the front surface 400, the back surface 405 may comprise any suitable data, such as numbers and/or letters, a specific color, or combinations thereof.

Figure 5:
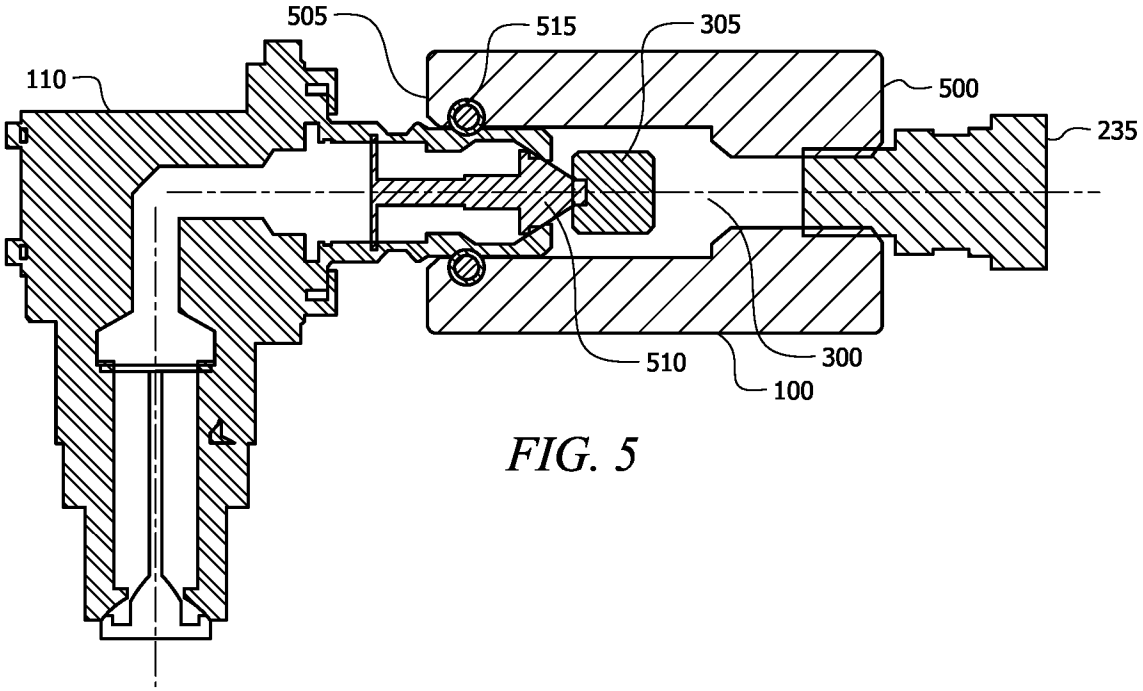
FIG. 5 illustrates an example cross-section view of the pressure relief shipping adapter in FIG. 1 coupled to the example bottle head assembly in FIG. 2, according to certain embodiments.

FIG. 5 illustrates a cross-sectional view of the pressure relief shipping adapter 100 coupled to the bottle head assembly 110. As illustrated, the pressure relief valve 235 may be disposed at a first end 500 of the second bore 300 and the bottle head assembly 110 may be coupled to a second end 505 of the second bore 300 opposite from the first end 500. A valve 510 of the bottle head assembly 110 may be at least partially inserted into the second bore 300. The valve 510 may be operable to vent and/or relieve the contents of the container 105 (referring to FIG. 1) as the bottle head assembly 110 is in fluid communication with the interior of the container 105. In embodiments, the valve 510 may be actuated when depressed by an external structure. As the valve 510 is inserted into the second bore 300, the valve 510 may be actuated by the valve depressor 305. In other embodiments, the valve 510 may be disposed adjacent to and abut the valve depressor 305, when inserted into the second bore 300, and there may be actuation through the mechanical switch 205 (referring to FIG. 2). As illustrated, there may be a seal 515 disposed in the second bore 300 configured to seal the valve 510 or the bottle head assembly 110 against the pressure relief shipping adapter 100. The seal 515 may prevent any gas released by the valve 510 from escaping through the coupling of the bottle head assembly 110 to the pressure relief shipping adapter 100. In embodiments, at least a portion of the released gas from the valve 510 into the second bore 30 may be expelled from the pressure relief shipping adapter 100 through the pressure relief valve 235, wherein the pressure relief valve 235 may provide communication to an external environment until the predetermined threshold value of the pressure relief valve 235 is met.

The present disclosure may provide numerous advantages, such as the various technical advantages that have been described with respective to various embodiments and examples disclosed herein. Other technical advantages will be readily apparent to one skilled in the art from the following figures, descriptions, and claims. Moreover, while specific advantages have been enumerated in this disclosure, various embodiments may include all, some, or none of the enumerated advantages.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A pressure relief shipping adapter, comprising:

a body comprising a first portion and a second portion, wherein:

the first portion comprises a first bore and a set of protrusions;

a hole is disposed through the set of protrusions;

the second portion comprises a second bore;

the second bore comprises a radial gap comprising a uniform arc length along a length of the radial gap; and a first end and a second end of the radial gap comprise a greater arc length than the radial gap;

a pressure relief valve disposed at a first end of the first bore; and an interlocking component comprising a first tab and a second tab, wherein the interlocking component is at least partially contained within the second bore.

2. The pressure relief shipping adapter of claim 1, further comprising a valve depressor disposed within the first bore.

3. The pressure relief shipping adapter of claim 2, further comprising a seal disposed within the first bore.

4. The pressure relief shipping adapter of claim 1, wherein the first tab is disposed within the first end of the radial gap at a first position.

5. The pressure relief shipping adapter of claim 4, wherein the first tab is disposed within the second end of the radial gap at a second position.

6. A container pressure system, comprising:

a bottle head assembly coupled to a container, wherein the container comprises a pressurized gas and the bottle head assembly comprises a mechanical switch and a valve; and a pressure relief shipping adapter coupled to the bottle head assembly, the pressure relief shipping adapter comprising:

a body comprising a first portion and a second portion, wherein:

the first portion comprises a first bore and a set of protrusions;

a hole is disposed through the set of protrusions;

the second portion comprises a second bore;

the second bore comprises a radial gap comprising a uniform arc length along a length of the radial gap; and a first end and a second end of the radial gap comprise a greater arc length than the radial gap;

a pressure relief valve disposed at a first end of the first bore; and an interlocking component comprising a first tab and a second tab, wherein the interlocking component is at least partially contained within the second bore.

7. The container pressure system of claim 6, wherein the pressure relief shipping adapter further comprises a valve depressor and a seal disposed within the first bore, and wherein the valve of the bottle head assembly is inserted into a second end of the first bore.

8. A pressure relief shipping adapter, comprising:

a body;

a first bore within the body, the first bore comprising:

a first end and a second end;

a valve depressor disposed within the first bore;

a seal disposed within the first bore, the seal configured to contact a valve of a bottle head assembly;

a second bore within the body, the second bore comprising a radial gap;

an interlocking component disposed at least partially within the second bore, the interlocking component comprising a tab disposed at least partially within the radial gap, the interlocking component configured to move from a first position to a second position, wherein:

when the interlocking component is in the first position, the valve of the bottle head assembly is not actuated; and when the interlocking component is in the second position, the valve of the bottle head assembly is actuated, thereby venting any contents of a container coupled to the bottle head assembly.

9. The pressure relief shipping adapter of claim 8, further comprising a pressure relief valve disposed at the first end of the first bore.

10. The pressure relief shipping adapter of claim 8, wherein the interlocking component comprises a front surface that is visible when the interlocking component is in the first position, the front surface comprising information to convey that the container is not ready for shipment.

11. The pressure relief shipping adapter of claim 8, wherein the interlocking component comprises a back surface that is visible when the interlocking component is in the second, the back surface comprising information to convey that the container is ready for shipment.

12. The pressure relief shipping adapter of claim 8, further comprising a set of protrusions configured to couple the pressure relief shipping adapter to the bottle head assembly.

13. The pressure relief shipping adapter of claim 8, wherein the interlocking component comprises a lateral bar, a set of coupling bars, and a set of hinges.

14. The pressure relief shipping adapter of claim 8, wherein the interlocking component comprises a second tab.

* * * * *